US006002306A

United States Patent [19]

Arakawa

[11] Patent Number: 6,002,306

[45] Date of Patent: Dec. 14, 1999

[54] DIELECTRIC FILTER AND DIELECTRIC DUPLEXER EACH HAVING A PLURALITY OF DIELECTRIC RESONATORS CONNECTED IN SERIES BY A DIELECTRIC COUPLING WINDOW

[75] Inventor: Shigeji Arakawa, Kanazawa, Japan

[73] Assignee: Murata Manufacturing Co., Ltd., Japan

[21] Appl. No.: 09/013,666

[22] Filed: Jan. 26, 1998

[30] Foreign Application Priority Data

Jan. 24, 1997 [JP] Japan ..... 9-010840
Dec. 17, 1997 [JP] Japan ..... 9-348292

[51] Int. Cl.[6] ..... H01P 5/12; H01P 7/10

[52] U.S. Cl. ..... 333/134; 333/202

[58] Field of Search ..... 333/202, 208, 333/209, 212, 126, 129, 134, 135

[56] References Cited

U.S. PATENT DOCUMENTS 4,607,242 8/1986 Cozzie ..... 333/208 X
4,910,481 3/1990 Sasaki et al. ..... 333/134

FOREIGN PATENT DOCUMENTS 294903 4/1990 Japan .
4-37203 2/1992 Japan ..... 333/202
853721 8/1981 U.S.S.R. ..... 333/208
1376139 2/1988 U.S.S.R. ..... 333/208

*Primary Examiner*—Seungsook Ham
*Attorney, Agent, or Firm*—Ostrolenk, Faber, Gerb & Soffen, LLP

[57] ABSTRACT

A dielectric filter is formed of resonators connected in series with dielectric coupling windows disposed therebetween. When the dielectric constant of the dielectrics which form the dielectric coupling windows is made different from that of the dielectrics which form the resonators, dielectric filter having the same central frequency and a different pass-band width is obtained without changing the shape and dimensions of the dielectric coupling windows.

6 Claims, 6 Drawing Sheets

DIELECTRIC FILTER AND DIELECTRIC DUPLEXER EACH HAVING A PLURALITY OF DIELECTRIC RESONATORS CONNECTED IN SERIES BY A DIELECTRIC COUPLING WINDOW

BACKGROUND OF THE INVENTION

1. Field of the Invention

The present invention relates to dielectric filters and dielectric duplexers, and more particularly, to a dielectric filter for use in a communication unit in the microwave band and the millimeter-wave band.

2. Description of the Related Art

A conventional type of dielectric filter for use in a communication unit in the microwave band and the millimeter-wave band is a multiple-stage filter in which dielectrics having a low dielectric constant sandwich a plurality of TEM-mode coaxial resonators (see Japanese Unexamined Patent Publication No. 2-94903). In this type of dielectric filter, a TEM-mode coaxial resonator in each stage independently functions as a resonator.

Communication units using such a filter have been required to handle higher-frequency signals as more channels have been demanded, but at a high frequency (such as in the 3-GHz band), a dielectric filter formed of a plurality of TEM-mode coaxial resonators has a very low no-load Q value and high transmission losses.

To overcome the above problems, there has been proposed a waveguide-type dielectric filter 40 using the $TE_{10}$ mode, as shown in FIG. 11 for example. This dielectric filter 40 has three $TE_{10}$-mode resonators 51 and two dielectric coupling windows 52. The $TE_{10}$-mode resonators 51 are connected in series with the dielectric coupling windows 52 disposed therebetween.

The resonators 51 and the dielectric coupling windows 52 are formed of a dielectric block 41 made from one material and having almost a rectangular-parallelepiped shape, on which an outer conductive member 43 is provided to cover almost the entire surface of the dielectric block 41. A pair of input and output electrodes 45 not electrically connected to the outer conductive member 43 with the a gap between the electrodes 45 and the member 43 are provided respectively at the two ends of the dielectric block 41. To set the central frequency of each resonator 51 to the desired value, the length of each resonator 51 needs to be set to approximately half the wavelength $\lambda$ of the central-frequency signal. To set the pass-band width of the dielectric filter 40 to the desired value, it is necessary to set the width W1 of the dielectric coupling windows 52 appropriately.

Although the proposed dielectric filter of FIG. 11 has a high no-load Q value and a small loss at a high frequency band, it is difficult to manufacture. Since the resonators 51 and the dielectric coupling windows 52 are made from the same dielectric material in the proposed dielectric filter, they have the same dielectric constant. Therefore, in order to manufacture a plurality of dielectric filters having the same central frequency and different pass-band widths, the width W1 of the dielectric coupling windows 52 needs to be changed and thereby the shape or the dimensions of the dielectric block 41 must be changed. A forming metal die is required for each of the plurality of dielectric filters.

There is a method for manufacturing a plurality of dielectric filters having different pass-band widths with the same forming metal die. A rectangular-parallelepiped dielectric block is formed by a metal forming die. Two pairs of grooves opposing each other with a gap therebetween are formed on both sides of the dielectric block by cutting with a dicing saw. A portion sandwiched between each pair of grooves in the dielectric block serves as a dielectric coupling window. To manufacture a plurality of dielectric filters having the same central frequency and different pass-band widths, it is also necessary in this method to change the blade-feeding distance (which equals the depth of the groove) of the dicing saw to modify the width of the dielectric coupling window for each of the plurality of dielectric filters.

SUMMARY OF THE INVENTION

Accordingly, it is an object of the present invention to provide a dielectric filter and a dielectric duplexer in which the pass-band width can be changed without modifying its shape and dimensions.

The foregoing object is achieved through the provision of a dielectric filter or a dielectric duplexer in which the dielectric constant of the dielectrics which form TE-mode resonators is different from that of the dielectric which forms a dielectric coupling window.

With the shape and dimensions of the dielectric coupling window not being changed, when the dielectric constant of the dielectric which forms the dielectric coupling window is set larger than that of the dielectrics which form the resonators, the amount of coupling between adjacent resonators increases and thereby the pass-band width of the dielectric filter increases. Conversely, with the shape and dimensions of the dielectric coupling window not being changed, when the dielectric constant of the dielectric which forms the dielectric coupling window is set smaller than that of the dielectrics which form the resonators, the amount of coupling between adjacent resonators decreases and thereby the pass-band width of the dielectric filter is reduced.

According to the present invention, by making the dielectric constant of the dielectric which forms the dielectric coupling window different from that of the dielectrics which form the TE-mode resonators, a dielectric filter or a dielectric duplexer having the same central frequency and a different pass-band width is obtained without changing the shape and dimensions of the dielectric coupling window.

As a result, a dielectric filters having the same central frequency and different pass-band widths and having the same dimensions and the same shape can be obtained by the use of the same forming metal forming die. Therefore, number of metal the types of forming dies is substantially reduced, and thereby the manufacturing cost also reduced.

DESCRIPTION OF THE PREFERRED EMBODIMENTS

Dielectric filters according to embodiments of the present invention will be described below by referring to the accompanying drawings. In each embodiment, the same symbols are assigned to the same components or the same portions.

Figure 1:
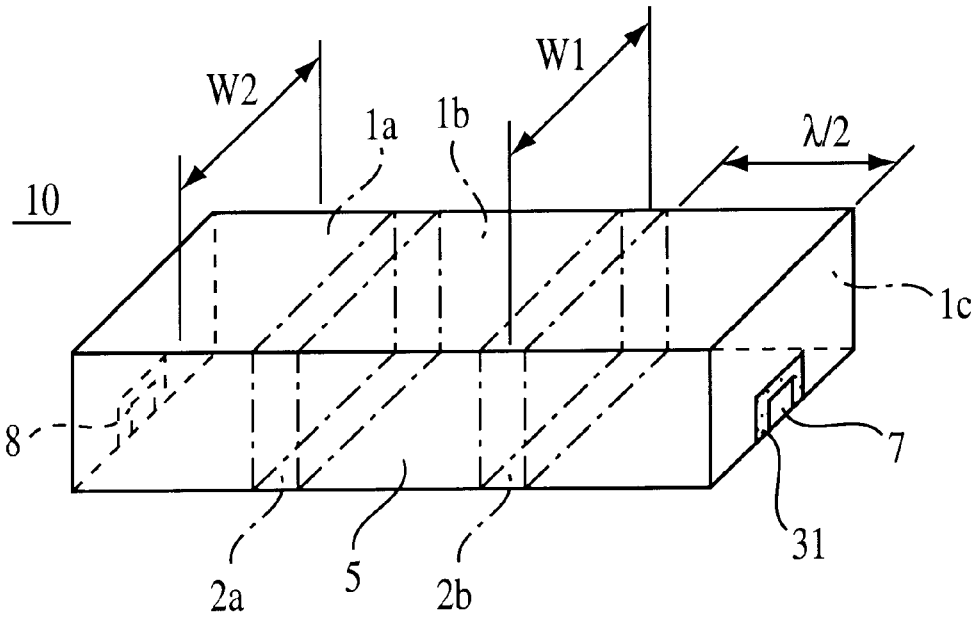
FIG. 1 is a perspective view of a dielectric filter according to a first embodiment of the present invention.

FIG. 1 is a perspective view of a dielectric filter according to a first embodiment of the present invention. A dielectric filter 10 has a rectangular cross section and includes three $TE_{10}$-mode resonators 1*a*, 1*b*, and 1*c*, and two dielectric coupling windows 2*a* and 2*b*. The resonators 1*a*, 1*b*, and 1*c* are connected in series as a unit with the dielectric coupling windows 2*a* and 2*b* disposed therebetween. In order to set the central frequency of the resonators 1*a*, 1*b*, and 1*c* to the desired value, the length of each of the resonators 1*a*, 1*b*, and 1*c* is set to half the wavelength λ of the central-frequency signal.

Figure 2:
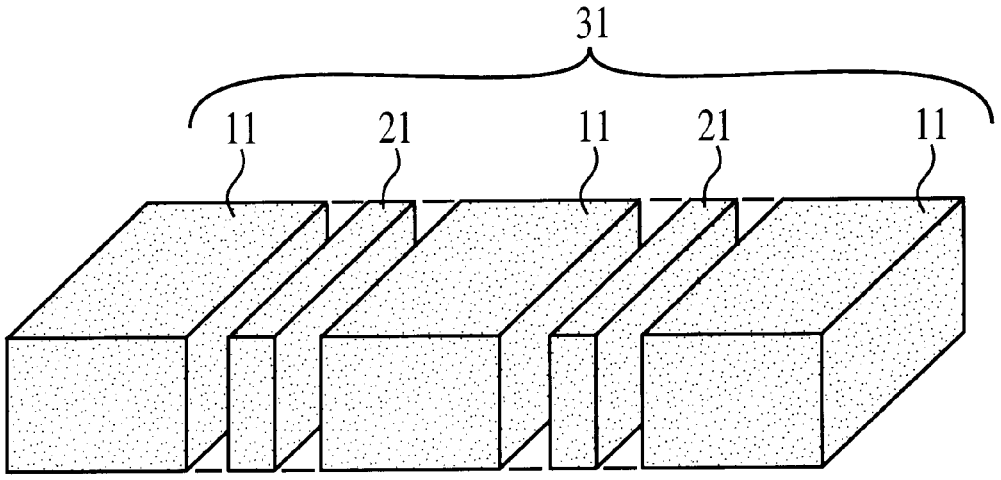
FIG. 2 is an exploded perspective view of the dielectric filter shown in FIG. 1.

The resonators 1*a*, 1*b*, and 1*c* and the dielectric coupling windows 2*a* and 2*b* are formed as follows: As shown in FIG. 2, dielectrics 11 for the resonators 1*a*, 1*b*, and 1*c* and dielectrics 21 for the dielectric coupling windows 2*a* and 2*b* are prepared. The dielectrics 11 and 21 are made from dielectric powder kneaded with a binder to make slurry, shaped, and dried. The dielectric 11 and 21 have different dielectric constants. The dielectrics 11 and 21 are disposed in a metal forming die such that the dielectrics 11 sandwich the dielectrics 21. Heat and pressure are applied to the dielectrics 11 and 21 by the metal forming die. They are baked as a unit to form a rectangular-parallelepiped dielectric block 31. As shown in FIG. 1, an outer conductive member 5 is formed so as to cover almost the entire surface of the baked dielectric block 31. At respective ends of the dielectric block 31, input and output electrodes 7 and 8 are formed which are not electrically connected to the outer conductive member 5 and with a gap between the electrodes and the outer conductive member 5.

As described above, the resonators 1*a*, 1*b*, and 1*c* are formed of the dielectrics 11 and the outer conductive member 5 provided on the outer surface of the dielectrics 11, and the dielectric coupling windows 2*a* and 2*b* are formed of the dielectrics 21 and the outer conductive member 5 provided on the outer surface of the dielectrics 21. In the first embodiment, the width W1 of the dielectric coupling windows 2*a* and 2*b* is set equal to the width W2 of the resonators 1*a*, 1*b*, and 1*c*.

The obtained dielectric filter 10 has a different structure from that of the conventional multiple-stage filter in which dielectrics having a low dielectric constant sandwich a TEM-mode coaxial resonator independent in each stage. In other words, the $TE_{10}$-mode resonators 1*a* to 1*c* in the dielectric filter 10 function in the same way as a waveguide serving as a transfer area. The dielectric coupling windows 2*a* and 2*b* of the dielectric filter 10 function in the same way as a waveguide serving as a blocking area. In a waveguide, it is necessary in general to partition the waveguide serving as a transfer area at both end faces with electromagnetic boundaries having a large reflection coefficient in order to trigger resonance.

Therefore, if the dielectric coupling windows 2*a* and 2*b* of the dielectric filter 10 are made from a dielectric material having the same dielectric constant as that of a dielectric material forming the resonators 1*a* to 1*c*, boundaries having a large reflection coefficient are provided at both ends of the dielectric filter 10, namely, at the outer end face of each of the resonators 1*a* and 1*c*. The dielectric filter 10 serves as a filter having a one-stage resonator.

On the other hand, in the dielectric filter 10 according to the first embodiment, the dielectric coupling windows 2*a* and 2*b* are made from a dielectric material having a different dielectric constant from that of a dielectric material forming the resonators 1*a* to 1*c*. The resonators 1*a* to 1*c* sandwich members having a different dielectric constant, and thereby the resonators 1*a* to 1*c* function as resonators and the filter serves as a filter having a three-stage resonator. As described above, the dielectric coupling windows 2*a* and 2*b* function as electromagnetic boundaries having a large reflection coefficient for the resonators 1*a* to 1*c* as well as being electromagnetically coupled with the resonators 1*a* to 1*c*.

In the dielectric filter 10 configured as described above, when the dielectric constant of the dielectrics 21 which form the dielectric coupling windows 2*a* and 2*b* is set larger than that of the dielectrics 11 which form the resonators 1*a*, 1*b*, and 1*c*, the amount of coupling between the resonators 1*a* and 1*b* and that between the resonators 1*b* and 1*c* increase. Therefore, the pass-band width of the dielectric filter 10 increases. Conversely, when the dielectric constant of the dielectrics 21 which form the dielectric coupling windows 2*a* and 2*b* is set smaller than that of the dielectrics 11 which form the resonators 1*a*, 1*b*, and 1*c*, the amount of coupling between the resonators 1*a* and 1*b* and that between the resonators 1*b* and 1*c* are reduced, and thereby the pass-band width of the dielectric filter is reduced. As a result, even if the shape and the dimensions of the dielectric coupling windows 2*a* and 2*b* are not changed, when the dielectric constant of the dielectrics 21 which form the dielectric coupling windows 2*a* and 2*b* is made different from that of the dielectrics 11 which form the resonators 1*a*, 1*b*, and 1*c*, the dielectric filter 10 has the same central frequency and a different pass-band width. Since dielectric filters having the same central frequency and different pass-band widths can be manufactured by the use of the same metal forming metal die, the number of types of forming dies that are required is substantially reduced, and the manufacturing cost can thereby be reduced.

Figure 3:
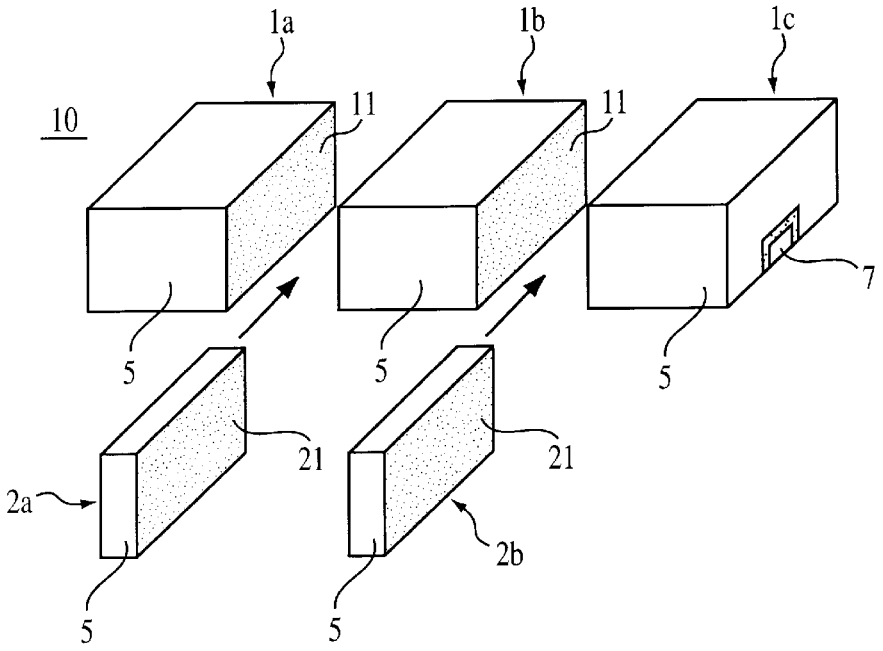
FIG. 3 is an exploded perspective view of a dielectric filter according to a second embodiment of the present invention.

FIG. 3 is an exploded perspective view of a dielectric filter according to a second embodiment of the present invention. A dielectric filter 10 includes three $TE_{10}$-mode resonators 1*a*, 1*b*, and 1*c*, and two dielectric coupling windows 2*a* and 2*b*. The resonators 1*a*, 1*b*, and 1*c* are connected in series with the dielectric coupling windows 2*a* and 2*b* disposed therebetween. The dielectric filter 10 has substantially the same structure as that shown in FIG. 1 in the first embodiment.

The resonators 1*a*, 1*b*, and 1*c*, and the dielectric coupling windows 2*a* and 2*b* are formed as follows: Unbaked dielectrics 11 for the resonators 1*a*, 1*b*, and 1*c* and unbaked dielectrics 21 for the dielectric coupling windows 2*a* and 2*b* are prepared. The dielectrics 11 and 21 have different dielectric constants. The unbaked dielectrics 11 and 21 are put into a metal forming die separately. Heat and pressure are applied to the dielectrics 11 and 21 through the metal forming die to bake them. By changing the dielectric constant of the dielectrics 21 which form the dielectric coupling windows 2*a* and 2*b* to make it different from that of the dielectrics 11 which form the resonators 1*a*, 1*b*, and 1*c*, even if the shape and the dimensions of the dielectrics 21 are not changed, the dielectric filter 10 has the same central frequency and a different pass-bandwidth. Since, the dielectrics 21 can be manufactured with the use of the same metal forming die, the required number of types of metal forming dies is substantially reduced.

An outer conductive member 5 is formed so as to cover the baked dielectrics 11 completely except for surfaces to be in contact with the dielectrics 21 and portions where input and output electrodes 7 and 8 are to be formed. An outer conductive member 5 is also formed so as to cover the baked dielectrics 21 completely except for surfaces to be in contact with the dielectrics 11.

The dielectric coupling windows 2*a* and 2*b* are disposed between the resonators 1*a*, 1*b*, and 1*c*. The resonators 1*a*, 1*b*, and 1*c* are bonded to the dielectric coupling windows 2*a* and 2*b* with insulating adhesive such as glass glaze applied to each contact surface to form a dielectric filter. The dielectric filter may be formed such that the baked dielectrics 11 and 21 are bonded together with insulating adhesive in advance to form a rectangular-parallelepiped dielectric block, and then the outer conductive member 5 is formed on the surface of the dielectric block so as to cover almost the entire dielectric block.

Figure 4:
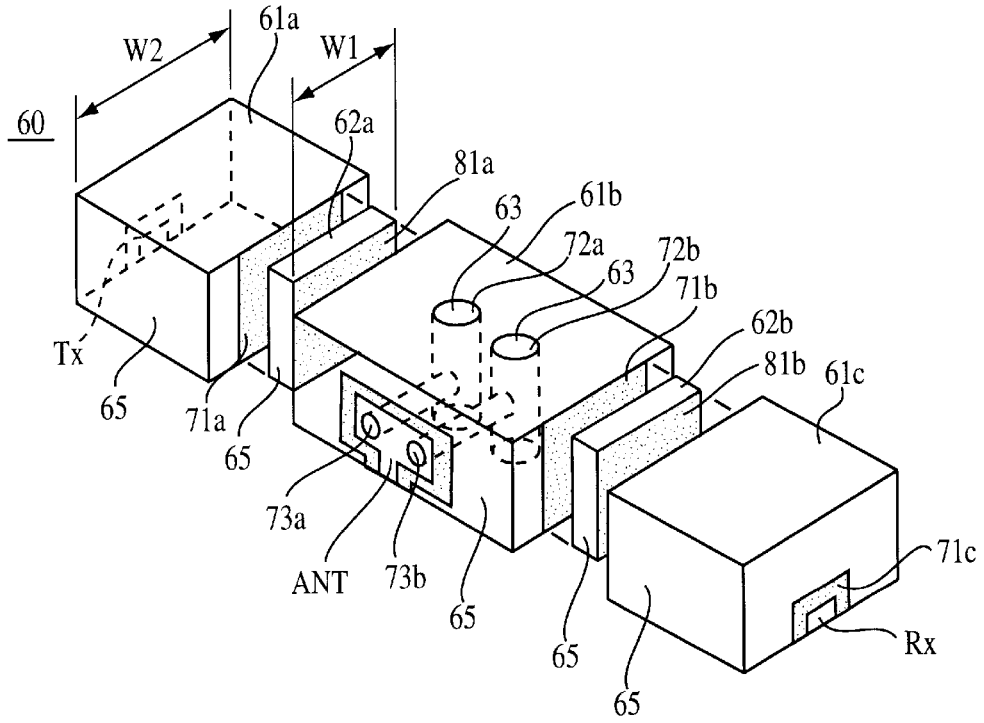
FIG. 4 is an exploded perspective view of a dielectric duplexer according to a third embodiment of the present invention.

A dielectric duplexer according to a third embodiment will be described below, which is for use in a mobile communication unit such as an automobile phone or a portable phone. As shown in FIG. 4, a dielectric duplexer 60 includes three $TE_{10}$-mode resonators 61*a*, 61*b*, and 61*c*, and two dielectric coupling windows 62*a* and 62*b*. The resonators 61*a* to 61*c* are connected in series as a unit with the dielectric coupling windows 62*a* and 62*b* disposed therebetween. The width W1 of the dielectric coupling windows 62*a* and 62*b* is set smaller than the width W2 of the resonators 61*a* to 61*c*. It is needless to say that the width W1 of the dielectric coupling windows 62*a* and 62*b* may also be set equal to the width W2 of the resonators 61*a* to 61*c*.

The resonators 61*a* to 61*c* and the dielectric coupling windows 62*a* and 62*b* are formed as follows: Unbaked dielectrics 71*a* to 71*c* for the resonators 61*a* to 61*c* and unbaked dielectrics 81*a* and 81*b* for the dielectric coupling windows 62*a* and 62*b* are prepared. The dielectric constant of the dielectrics 81*a* and 81*b* is different from that of the dielectrics 71*a* to 71*c*. In the dielectric 71*b*, two external coupling holes 72*a* and 72*b* passing through the upper and lower surfaces thereof are formed. Lead through holes 73*a* and 73*b* perpendicular to the two external coupling holes 72*a* and 72*b*, respectively, are also formed.

The unbaked dielectrics 71*a* to 71*c*, 81*a*, and 81*b* are put into a metal forming die separately. Heat and pressure are applied to the dielectrics 71*a* to 71*c*, 81*a*, and 81*b* by forming die to bake them. By making the dielectric constant of the dielectrics 81*a* and 81*b* which form the dielectric coupling windows 62*a* and 62*b* different from that of the dielectrics 71*a* to 71*c* which form the resonators 61*a* to 61*c*, even if the shape and the dimensions of the dielectrics 81*a* and 81*b* is not changed, the resulting dielectric duplexer 60 can be made with the same central frequency and a different pass-band width. Therefore, the dielectrics 81*a* and 81*b* can be manufactured with the use of the same metal forming die, and thereby the required number of types of forming metal dies is substantially reduced.

An outer conductive member 65 is formed so as to cover the surfaces of the sintered dielectrics 71*a* to 71*c* except for portions in contact with the dielectrics 81*a* and 81*b*, a transmitting electrode Tx and a receiving electrode Rx serving as input and output electrodes, and a portion where an antenna electrode ANT is formed. Inner conductive members 63 are formed on the entire inner surfaces of the external coupling holes 72*a* and 72*b* and the lead through holes 73*a* and 73*b*. The inner conductive members 63 are electrically connected to the outer conductive member 65 at both ends of the external coupling holes 72*a* and 72*b*, and are electrically connected to the antenna electrode ANT at one end of each of the lead through holes 73*a* and 73*b*. Therefore, the external coupling holes 72*a* and 72*b* are electrically connected to the antenna electrode ANT through the lead through holes 73*a* and 73*b*, respectively. In the same way, an outer conductive member 65 is formed so as to cover the surfaces of the sintered dielectrics 81*a* and 81*b* except for the portions in contact with the dielectrics 71*a* to 71*c*.

Figure 5:
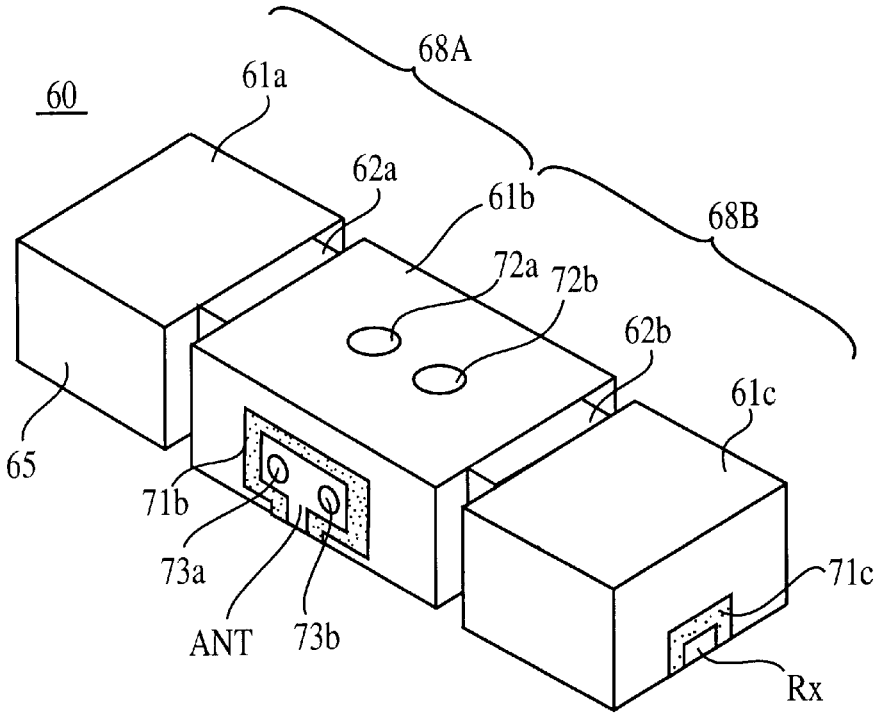
FIG. 5 is a perspective view of the dielectric duplexer of FIG. 4.

As shown in FIG. 5, the dielectric coupling windows 62*a* and 62*b* are disposed between the resonators 61*a*, 61*b*, and 61*c*. The resonators 61*a* to 61*c* are bonded to the dielectric coupling windows 62*a* and 62*b* with insulating adhesive such as glass glaze applied to each contact surface to form the dielectric duplexer 60. The dielectric duplexer may be formed by first bonding the sintered dielectrics 71*a* to 71*c*, 81*a*, and 81*b* together with insulating adhesive in advance to form a unit, and then forming the outer conductive member 65.

The dielectric duplexer 60 having the above structure includes a transmission filter (bandpass filter) 68A formed of the resonator 61*a*, the dielectric coupling window 62*a*, and approximately the left-hand half of the resonator 61*b*, and a receiving filter (bandpass filter) 68*b* formed of the resonator 61*c*, the dielectric coupling window 62*b*, and approximately the right-hand half of the resonator 61*b*. This dielectric duplexer 60 outputs a signal received from the antenna electrode ANT, through the receiving filter 68B from the receiving electrode Rx to a receiving circuit system not shown, and also outputs a transmission signal input from a transmission circuit system not shown to the transmitting electrode Tx, through the transmission filter 68A to the antenna electrode ANT.

A dielectric filter and a dielectric duplexer according to the present invention are not limited to the above embodiments. They can be changed in various ways within the scope of the invention.

Figure 6:
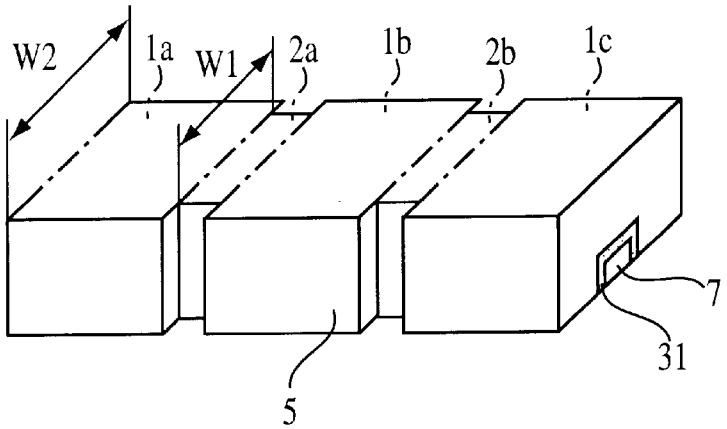
FIG. 6 is a perspective view of a dielectric filter according to a fourth embodiment of the present invention.
Figure 7:
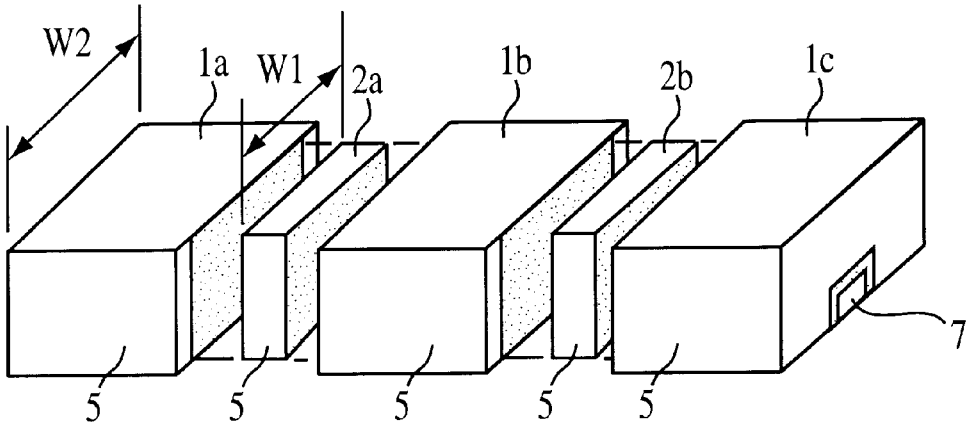
FIG. 7 is an exploded perspective view of a dielectric filter according to a fifth embodiment of the present invention.

In the first and second embodiments, the width W1 of the dielectric coupling windows 2*a* and 2*b* is set equal to the width W2 of the resonators 1*a*, 1*b*, and 1*c*. The setting of the widths is not so limited. As shown in FIGS. 6 and 7, the width W1 of the dielectric coupling windows 2*a* and 2*b* may be set smaller than the width W2 of the resonators 1*a*, 1*b*, and 1*c*. Also in this case, by making the dielectric constant of the dielectrics 21 which form the dielectric coupling windows 2*a* and 2*b* different from that of the dielectrics 11 which form the resonators 1*a*, 1*b*, and 1*c*, the dielectric filter 10 having the same central frequency and a different pass-band width is obtained without changing the shape and the dimensions of the dielectric coupling windows 2*a* and 2*b*.

Figure 8:
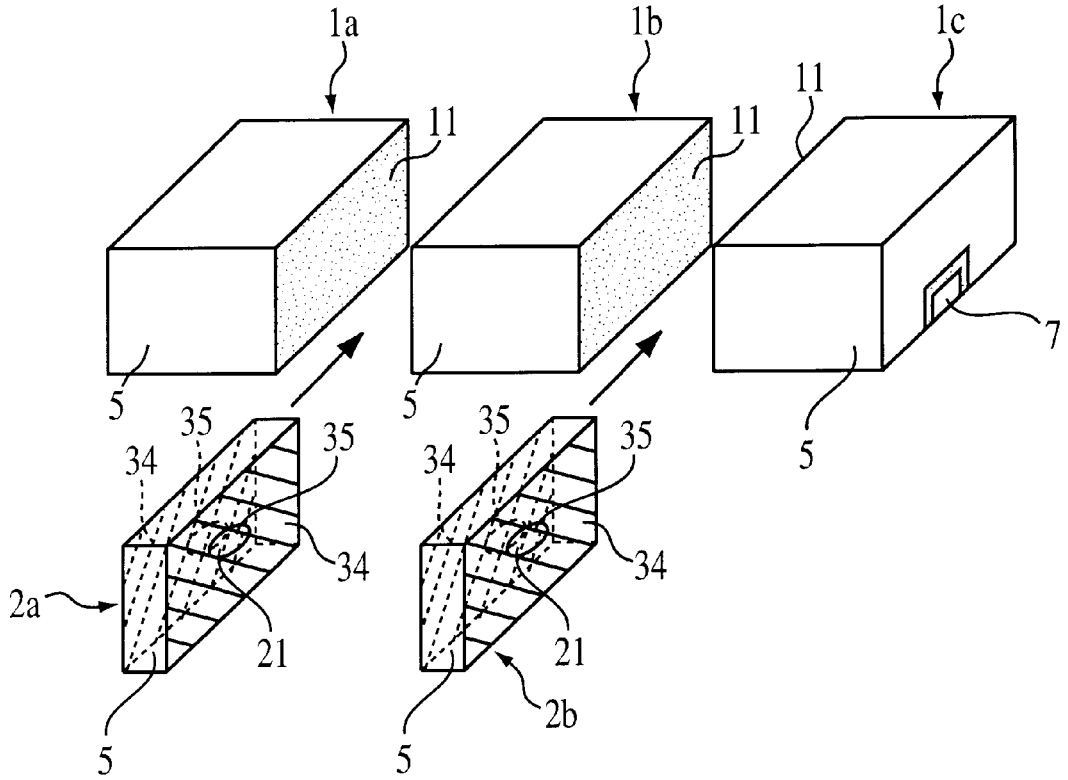
FIG. 8 is an exploded perspective view of a dielectric filter according to a sixth embodiment of the present invention.

Electrically conductive adhesive such as silver paste and solder paste may be used to bond the resonators 1*a*, 1*b*, and 1*c* to the dielectric coupling windows 2*a* and 2*b* in the second embodiment. In this case, as shown in FIG. 8, for example, electrically conductive adhesive 34 is applied to hatched areas, excluding circular windows 35, on both contact surfaces of each of the dielectric coupling windows 2*a* and 2*b*. Through the circular windows 35, the resonators 1*a*, 1*b*, and 1*c* are electromagnetically coupled.

Figure 9:
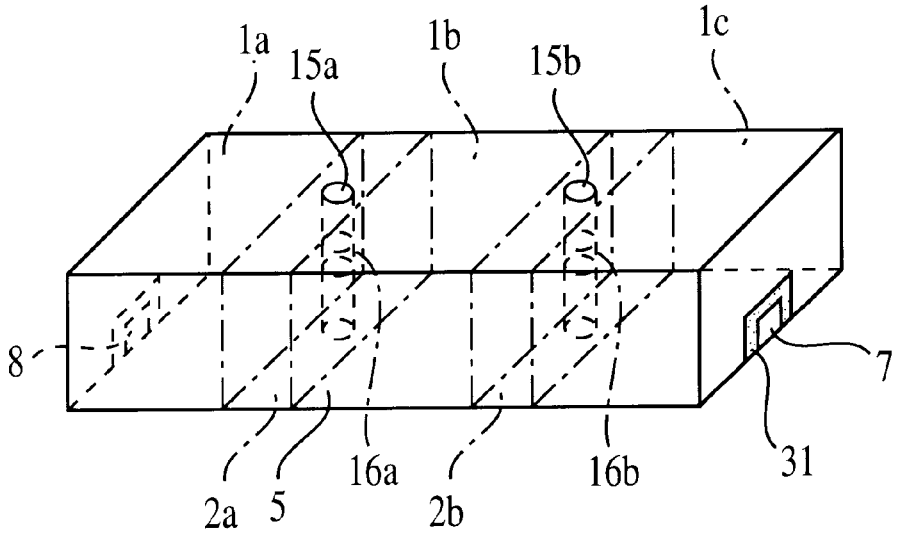
FIG. 9 is a perspective view of a dielectric filter according to a seventh embodiment of the present invention.

A dielectric coupling window may be provided with a coupling adjustment hole. Specifically, as shown in FIG. 9, in the dielectric filter 10 according to the first embodiment, coupling adjustment holes 15*a* and 15*b* are formed in the dielectric coupling windows 2*a* and 2*b*. The coupling adjustment holes 15*a* and 15*b* have a circular cross section and pass through from the upper surfaces to the lower surfaces of the dielectric coupling windows 2*a* and 2*b*, respectively. Inner conductive members 17 (see FIG. 10) are formed on the inner walls of the coupling adjustment holes 15*a* and 15*b*.

Figure 10:
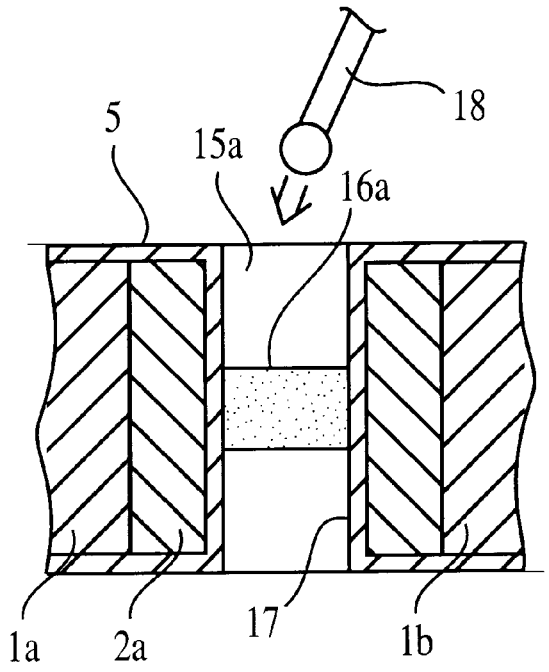
FIG. 10 is an enlarged sectional view of the coupling adjustment holes of the dielectric filter of FIG. 9.
Figure 11:
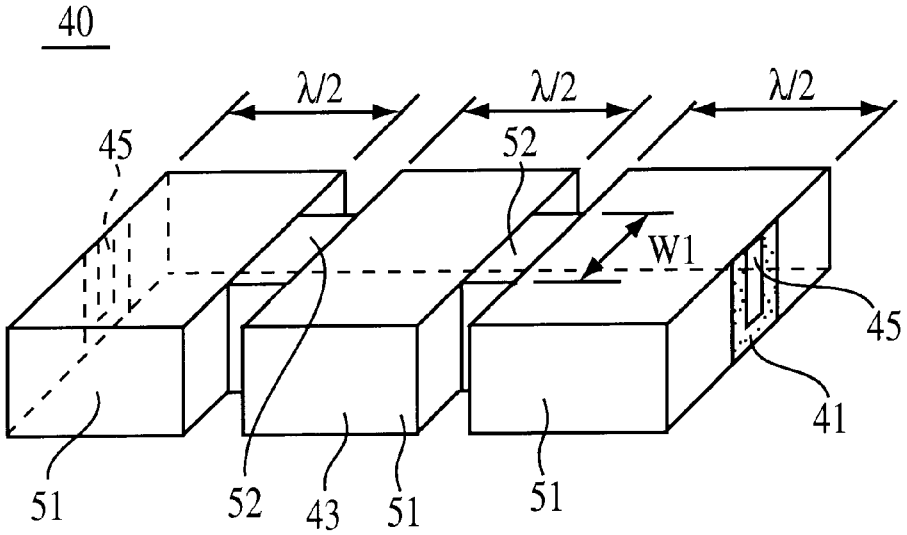
FIG. 11 PRIOR ART
FIG. 11 is a perspective view of a conventional dielectric filter.

Parts of the inner conductors 17 are removed to form portions 16*a* and 16*b* without inner conductors thereon, and thereby characteristics such as a pass-band width are adjusted. To adjust the pass-band width, characteristics of the dielectric filter 10 such as the pass-band width are measured first. Then, according to the measurement results, as shown in FIG. 10, a cutting tool 18 such as a router is inserted into the coupling adjustment holes 15*a* and 15*b* through the openings of the holes 15*a* and 15*b*, and the desired parts of the inner conductors 17, which are exposed on the inner surfaces of the coupling adjustment holes 15*a* and 15*b*, are removed to form the portions 16*a* and 16*b* where there are no inner conductors. Characteristics such as the pass-band width are adjusted by adjusting the sizes and positions of the portions 16*a* and 16*b*. Therefore, even after the dielectric filter 10 has been assembled, characteristics such as a pass-band width can be adjusted, further facilitating adjustment work.

The coupling adjustment holes 15*a* and 15*b* do not necessarily pass through from the upper surfaces to the lower surfaces of the dielectric coupling windows 2*a* and 2*b*. They may pass through from the front side face to the back side face, or may have their axes formed at angles with respect to the outer surfaces of the dielectric coupling windows 2*a* and 2*b*. The coupling adjustment holes 15*a* and 15*b* may have rectangular rather than circular cross-sections.

A three-stage dielectric filter in which three resonators are connected in series is described in the first and second embodiments. The number of stages is not limited to this case. It may be two, or four or more.

A dielectric filter of the present invention can have various shapes according to the specification. In addition to a rectangular cross section, the dielectric filter may have a circular cross section. It may be a coaxial line.

While the invention has been particularly shown and described with reference to preferred embodiments thereof, it will be understood by those skilled in the art that the foregoing and other changes in form and details may be made therein without departing from the spirit of the invention.

What is claimed is:

1. A dielectric filter comprising:

a pair of TE-mode dielectric resonators which are connected in series by a solid dielectric coupling window disposed between said pair of resonators;

each of said dielectric resonators and said dielectric coupling window being composed of dielectric material which has a dielectric constant;

wherein the dielectric constant of the dielectric material which forms said pair of TE-mode resonators is higher than the dielectric constant of the dielectric material which forms said dielectric coupling window and wherein said pair of TE-mode resonators function as waveguides providing respective transfer areas and said dielectric window functions as a waveguide providing a blocking area.

2. A dielectric filter as claimed in claim 1, wherein said dielectric filter defines lengthwise and transverse directions, and said dielectric coupling window is substantially the same as said dielectric resonators in transverse shape and size.

3. A dielectric filter as claimed in claim 1, wherein said dielectric filter defines lengthwise and transverse directions, and said dielectric coupling window is substantially smaller than said dielectric resonators in at least one transverse direction.

4. A dielectric filter comprising:

a pair of TE-mode dielectric resonators which are connected in series by a dielectric coupling window disposed between said pair of resonators;

each of said dielectric resonators and said dielectric coupling window being composed of dielectric material which has a dielectric constant;

wherein the dielectric constant of the dielectric material which forms said pair of TE-mode resonators is different from the dielectric constant of the dielectric material which forms said dielectric coupling windows and wherein said dielectric coupling window comprises a coupling adjusting hole.

5. A dielectric duplexer comprising:

two filters, a common terminal connected to both of said filters, and a pair of input/output terminals each connected to a respective one of said filters; each of said filters comprising:

a pair of TE-mode dielectric resonators which are connected in series by a solid dielectric coupling window disposed between said pair of resonators;

each of said dielectric resonators and said dielectric coupling window being composed of dielectric material which has a dielectric constant;

wherein the dielectric constant of the dielectric material which forms said pair of TE-mode resonators is higher than the dielectric constant of the dielectric material which forms said dielectric coupling windows and wherein said pair of TE-mode resonators function as waveguides providing respective transfer areas and said dielectric window functions as a waveguide providing a blocking area.

6. A dielectric duplexer as claimed in claim 5, wherein each said dielectric filter defines lengthwise and transverse directions, and each said dielectric coupling window is substantially smaller than the corresponding said dielectric resonators in at least one transverse direction.

* * * * *